US009539839B2

(12) United States Patent
Maekawa

(10) Patent No.: US 9,539,839 B2
(45) Date of Patent: Jan. 10, 2017

(54) LONG SHEET MATERIAL HOLDING DEVICE AND PRINTER

(71) Applicant: SATO HOLDINGS KABUSHIKI KAISHA, Tokyo (JP)

(72) Inventor: Hitoshi Maekawa, Kanagawa (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/900,454

(22) PCT Filed: Apr. 25, 2014

(86) PCT No.: PCT/JP2014/061775

§ 371 (c)(1),
(2) Date: Dec. 21, 2015

(87) PCT Pub. No.: WO2014/203622

PCT Pub. Date: Dec. 24, 2014

(65) Prior Publication Data

US 2016/0152057 A1 Jun. 2, 2016

(30) Foreign Application Priority Data

Jun. 21, 2013 (JP) ..... 2013-131098

(51) Int. Cl.
*B41J 33/14* (2006.01)
*B65H 16/06* (2006.01)
(Continued)

(52) U.S. Cl.
CPC ..... *B41J 33/14* (2013.01); *B41J 17/24* (2013.01); *B65H 16/06* (2013.01); *B65H 75/241* (2013.01);
(Continued)

(58) Field of Classification Search
CPC ..... B41J 17/24; B65H 2301/41344; B65H 75/241; F16D 1/072; B23B 2231/0264
See application file for complete search history.

(56) References Cited

U.S. PATENT DOCUMENTS 4,725,173 A * 2/1988 Hoffman ..... B23B 31/1077 279/67
4,886,392 A * 12/1989 Iio ..... B23P 11/00 29/525
(Continued)

FOREIGN PATENT DOCUMENTS

JP 2000-43385 2/2000
JP 2000-351493 12/2000
(Continued)

OTHER PUBLICATIONS

International Search Report dated Jul. 8, 2014 issued in corresponding International patent application No. PCT/JP2014/061775.
(Continued)

*Primary Examiner* — Stephen Meier
*Assistant Examiner* — John P Zimmermann
(74) *Attorney, Agent, or Firm* — Ostrolenk Faber LLP

(57) ABSTRACT

In order to obtain a ribbon feeding shaft capable of accurately adjusting a position of a regulating member and preventing a positional deviation, a long sheet material holding device includes a pair of first locking groove trains (91*c* and 91*d*) arranged in parallel with each other along the axial direction of the holding shaft (91), the pair of first locking groove trains (91*c* and 91*d*) having a series of grooves (61*c* and 61*d*) respectively, the series of grooves (61*c* and 61*d*) extending across the axial direction of the holding shaft (91), each of the series of grooves (61*c* and 61*d*) being provided with slope surfaces (71*c*, 71*d*) sloped along the axial direction of the holding shaft (91) and oppositely to each other and perpendicular surfaces (81*c*,
*(Continued)*

81*d*) perpendicular to the axial direction of the holding shaft (91), and a pair of second locking groove trains (92*c*, 92*d*) formed in a pair of locking members (92*x*, 92*y*) provided in the regulating member 92 inserted into the holding shaft (91), to match the surfaces of the pair of first locking groove trains (91*c* and 91*d*).

9 Claims, 10 Drawing Sheets

(51) Int. Cl.
*B41J 17/24* (2006.01)
*B65H 75/24* (2006.01)

(52) U.S. Cl.
CPC . *B65H 2301/41344* (2013.01); *B65H 2403/52* (2013.01); *B65H 2801/03* (2013.01); *B65H 2801/12* (2013.01)

(56) References Cited

U.S. PATENT DOCUMENTS 5,054,973 A * 10/1991 Knoller ..... B23B 31/005 408/226
5,272,930 A * 12/1993 Nakamura ..... B21D 53/845 29/888.1
5,348,210 A * 9/1994 Linzell ..... B23K 20/129 228/115
6,261,035 B1 * 7/2001 Moores, Jr. ..... B23B 51/00 279/137
6,592,287 B1 * 7/2003 Hagle ..... B23K 1/0008 228/258
6,883,997 B1 * 4/2005 Ruschmann ..... B21K 25/00 29/432
2001/0006202 A1 * 7/2001 Inana ..... B65H 16/06 242/348
2002/0041790 A1 * 4/2002 Suzuki ..... F16B 4/004 403/280
2014/0061359 A1 * 3/2014 Riegner, III ..... B65H 75/241 242/566

FOREIGN PATENT DOCUMENTS

JP 2005-161523 6/2005
JP 2005-314047 11/2005
JP 2013-32016 2/2013

OTHER PUBLICATIONS

Written Opinion dated Jul. 8, 2014 issued in corresponding International patent application No. PCT/JP2014/061775.

* cited by examiner

LONG SHEET MATERIAL HOLDING DEVICE AND PRINTER

CROSS REFERENCE TO RELATED APPLICATIONS

The present application is a 35 U.S.C. §371 National Phase conversion of PCT/JP2014/061775, filed Apr. 25, 2014, which claims benefit of Japanese Application No. 2013-131098, filed Jun. 21, 2013, the disclosure of which is incorporated herein by reference. The PCT International Application was published in the Japanese language.

TECHNICAL FIELD

This invention relates to a long sheet material holding device and a printer.

BACKGROUND ART

A printer is provided with a print head that prints predetermined information on a print medium and a print unit having a platen roller provided to face the print head by interposing the print medium. In addition, predetermined information is printed on a print medium by conveying the print medium while nipping it between the print head and the rotating platen roller.

For example, a printer using an ink ribbon impregnated with ink, such as a heat transfer type printer or a dot impact type printer, has a ribbon feeding shaft (as an example of the long sheet material holding device) and a ribbon winding shaft (as an example of the long sheet material holding device). In addition, the ink ribbon is delivered from the ribbon feeding shaft, passes through the print head, and is wound around the ribbon winding shaft so as to form a feeding route.

Here, the ribbon feeding shaft or the ribbon winding shaft has a holding shaft for winding and holding the ink ribbon in a roll-like manner, and a regulating member into which the holding shaft is inserted movably along an axial direction of the holding shaft so as to be locked in a plurality of portions in order to regulate the position of the regulating member depending on a width of the ink ribbon.

It is noted that, for example, in JP 2005-314047 A, there is discussed a method of conveying a paper sheet in a printer using an ink ribbon.

CITATION LIST

Patent Literatures

[Patent Literature 1] JP 2013-032016 A

SUMMARY OF INVENTION

In the ribbon feeding shaft or the ribbon winding shaft described above, an adjustable width of the regulating member is coarsely set. Therefore, it is difficult to accurately adjust the width. Therefore, it is difficult to regulate the regulating member in a suitable position of the holding shaft depending on various types of ink ribbons having different widths.

The accurate adjustment of the regulating member may be possible if a groove train having a plurality of grooves is formed in the holding shaft, and another groove train engaged with the aforementioned groove train is formed in the regulating member, so that both groove trains are locked to each other. However, when a strong force is applied to the regulating member, they may be easily unlocked so as to generate a positional deviation.

Such a problem is not only for the ribbon feeding shaft or the ribbon winding shaft, but is also a common problem of many long sheet material holding devices that hold the long sheet material such as an ink ribbon.

In view of the aforementioned problems, it is therefore an object of this invention to provide a long sheet material holding device and a printer using the same, capable of accurately adjusting a position of the regulating member with respect to the holding shaft and preventing a positional deviation of the regulating member even when a strong force is applied.

According to a first aspect of this invention, a long sheet material holding device includes a holding shaft configured to hold a long sheet material in a roll shape, a pair of first locking groove trains arranged in parallel with each other along the axial direction of the holding shaft, the pair of first locking groove trains having a series of grooves respectively, the series of grooves extending across the axial direction of the holding shaft, each of the series of grooves being provided with slope surfaces sloped along the axial direction of the holding shaft and oppositely to each other and perpendicular surfaces perpendicular to the axial direction of the holding shaft, a regulating member provided to allow the holding shaft to be inserted thereinto and to be movable along the axial direction of the holding shaft, the regulating member being configured to regulate a position of the long sheet material held by the holding shaft, and a pair of locking members provided in the regulating member to match the pair of first locking groove trains, each of the locking members having a second locking groove train, the second locking groove train having a series of grooves, the series of grooves having surfaces to match the slope surfaces and the perpendicular surfaces of the grooves of the first locking groove train, the second locking groove trains being engaged with the first locking groove trains to fix the regulating member to the holding shaft.

In the long sheet material holding device according to a second aspect of the invention, in addition to the first aspect of the present invention, each of the pair of the locking members includes a control knob manipulated by an operator and a groove train portion positioned oppositely to the control knob with respect to a swing point, the groove train portion being provided with the second locking groove train, the locking members being swingable between an engagement position where the second locking groove trains are engaged with the first locking groove trains and a disengagement position where the second locking groove trains are disengaged from the first locking groove trains, the long sheet material holding device further includes a biasing member configured to bias the locking member toward the engagement position, and the locking member is displaced from the engagement position to the disengagement position when the control knobs of the pair of locking members are manipulated against a biasing force of the biasing member.

In the long sheet material holding device according to a third aspect of the invention, in addition to the first or second aspect of the present invention, the holding shaft is provided with a scale, the scale indicating a fixation position of the regulating member corresponding to a width of the long sheet material with respect to the holding shaft.

In the long sheet material holding device according to a fourth aspect of the invention, in addition to any one of the first, second, and third aspect of the present invention, further includes a stopper inserted into one end of the holding shaft, the stopper being configured to prevent the regulating member from being removed from the holding shaft.

According to a fifth aspect of this invention, a printer includes a print head configured to print predetermined information on a print medium by using an ink ribbon impregnated with ink, a platen roller provided to face the print head by interposing the print medium, a ribbon feeding shaft configured to feed the ink ribbon to the print head, and a ribbon winding shaft configured to wind out the ink ribbon consumed by the print head, wherein any one of the ribbon feeding shaft and the ribbon winding shaft is the long sheet material holding device described above.

According to these aspects, both of a plurality of grooves of the first locking groove trains formed in the holding shaft and a plurality of grooves of the second locking groove trains formed in the locking member of the regulating member and engaged with the first locking groove trains are formed in series. Therefore, using the long sheet material holding device according to these aspects, it is possible to accurately adjust a position of the regulating member inserted into the holding shaft.

In addition, a pair of first locking groove trains formed in the holding shaft have a plurality of grooves extending across the axial direction of the holding shaft, each of the plurality of grooves having slope surfaces sloped along the axial direction of the holding shaft and oppositely to each other and perpendicular surfaces perpendicular to the axial direction of the holding shaft. Meanwhile, a pair of second locking groove trains provided in the locking member of the regulating member has a plurality of grooves having surfaces formed to match the slope surfaces and the perpendicular surfaces of the grooves of the first locking groove trains.

Therefore, in the long sheet material holding device according to these aspects, a slide of the regulating member is prevented in both directions of the holding shaft. Therefore, it is possible to improve a locking strength of the regulating member to the holding shaft. In addition, a positional deviation of the regulating member is not easily generated even when a strong force is applied to the regulating member.

DESCRIPTION OF EMBODIMENTS

Figure 1:
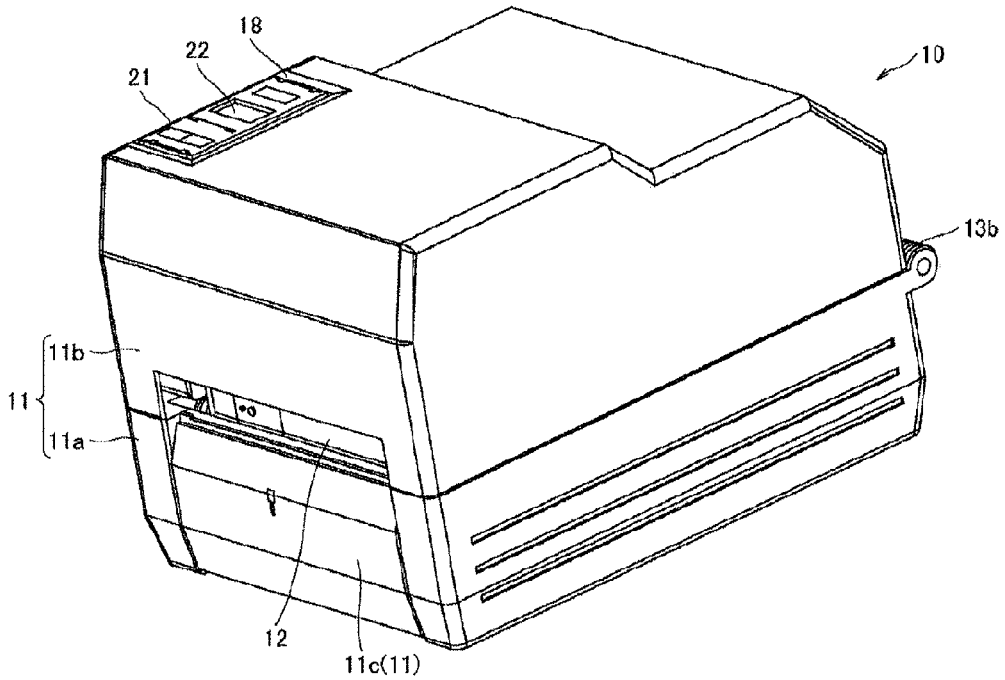
FIG. 1 is a perspective view illustrating appearance of a printer according to an embodiment of this invention.

A description will now be made for an embodiment of this invention in detail with reference to the accompanying drawings. It is noted that, in the drawings for describing the embodiments, like reference numerals denote like elements, and they will not be repeatedly described.

Figure 2:
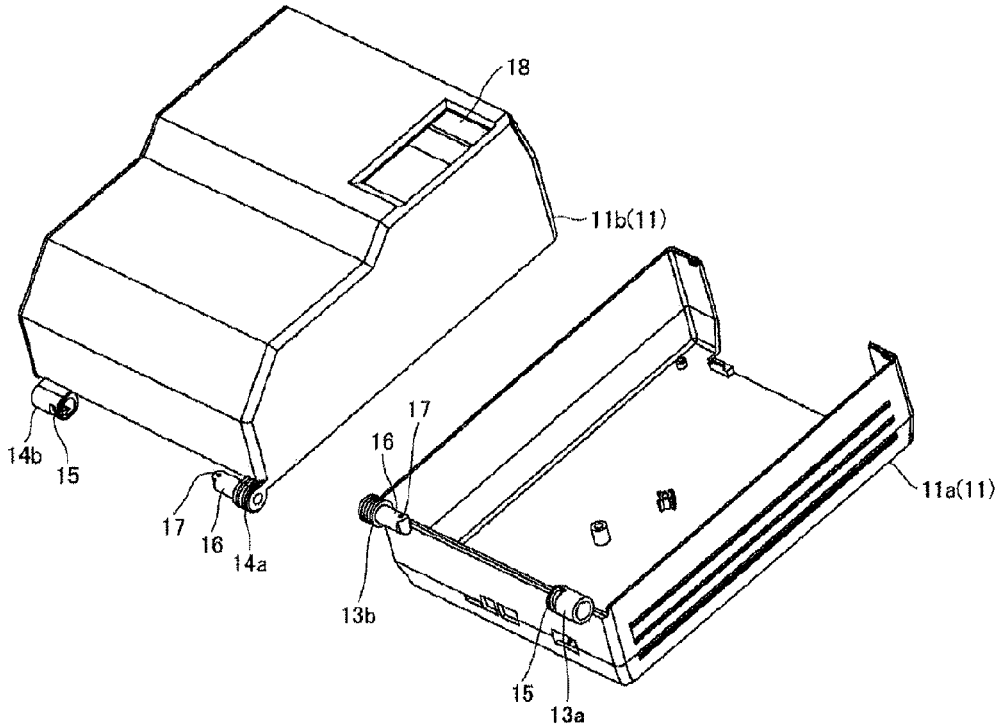
FIG. 2 is an exploded perspective view illustrating a housing of the printer of FIG. 1.
Figure 3:
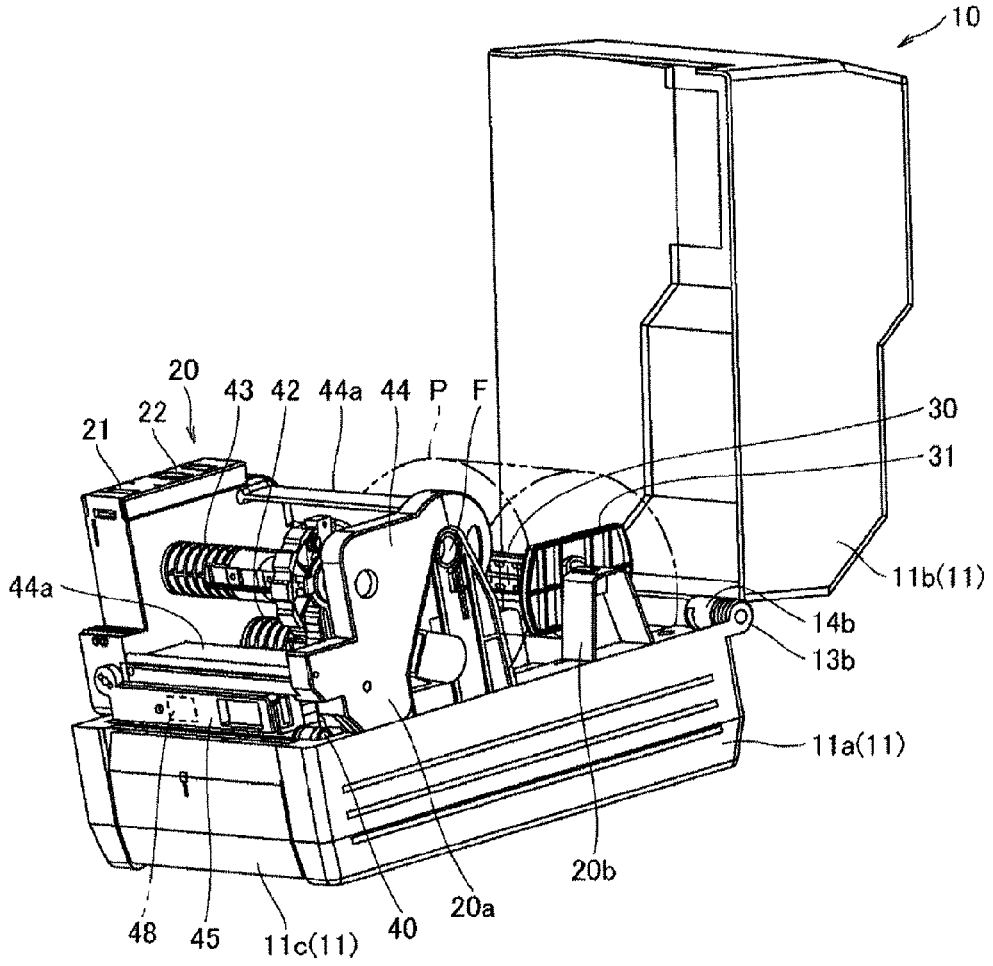
FIG. 3 is a perspective view illustrating the printer of FIG. 1 in which an upper casing is opened.

As illustrated in FIGS. 1 and 2, in a printer 10 according to this embodiment, a housing 11 has a lower casing 11*a*, an upper casing 11*b* as a cover installed open/closably to the lower casing 11*a*, and a front cover 11*c* that covers a notch portion formed on the front face of the lower casing 11*a*. In addition, a main body 20 is housed in the housing 11 as illustrated in FIG. 3. Furthermore, a horizontally long discharge port 12 for discharging a continuous paper sheet P (print medium) printed by the main body 20 is formed on the front face of the housing 11.

As illustrated in FIG. 2, a pair of hinge portions 13*a* and 13*b* are formed integrally with the lower casing 11*a* in a rear side of the lower casing 11*a*. In addition, in the rear side of the upper casing 11*b*, a hinge portion 14*a* corresponding to the hinge portion 13*a* and a hinge portion 14*b* corresponding to the hinge portion 13*b* are formed integrally with the upper casing 11*b*.

The hinge portions 13*a* and 14*b* have a cylindrical shape extending in a horizontal direction and has a long hole 15 formed across nearly a half circle. In addition, the hinge portions 13*b* and 14*a* have protrusions 16 inserted into the hinge portions 14*b* and 13*a*, respectively, having a cylindrical shape, and the leading edges of the protrusions 16 are provided with pin holes 17 visible through the long holes 15 when they are inserted into the hinge portions 14*b* and 13*a*.

Therefore, by sliding the lower and upper casings 11*a* and 11*b* relatively to each other in a horizontal direction to insert the hinge portion 14*a* to the hinge portion 13*a* and insert the hinge portion 13*b* to the hinge portion 14*b* and installing a stopper pin (not shown) to the pin hole 17 through the long hole 15, the upper casing 11*b* is open/closably installed to the lower casing 11*a*. In addition, by causing the stopper pin to move inside the long hole 15 and abut on its one end as the upper casing 11*b* is opened, it is possible to regulate a movable range of the upper casing 11*b*.

In FIGS. 1 and 2, a window hole 18 is provided on the upper face of the upper casing 11*b*. This window hole 18 is positioned to match an input unit 21 (unit for inputting various types of setup information such as the number of print sheets) and a display unit 22 (unit for displaying information input from the input unit) provided in the main body 20 housed in the housing 11, so that an operator can manipulate the input unit 21 and obtain information displayed on the display unit 22 by using this window hole 18.

Figure 4:
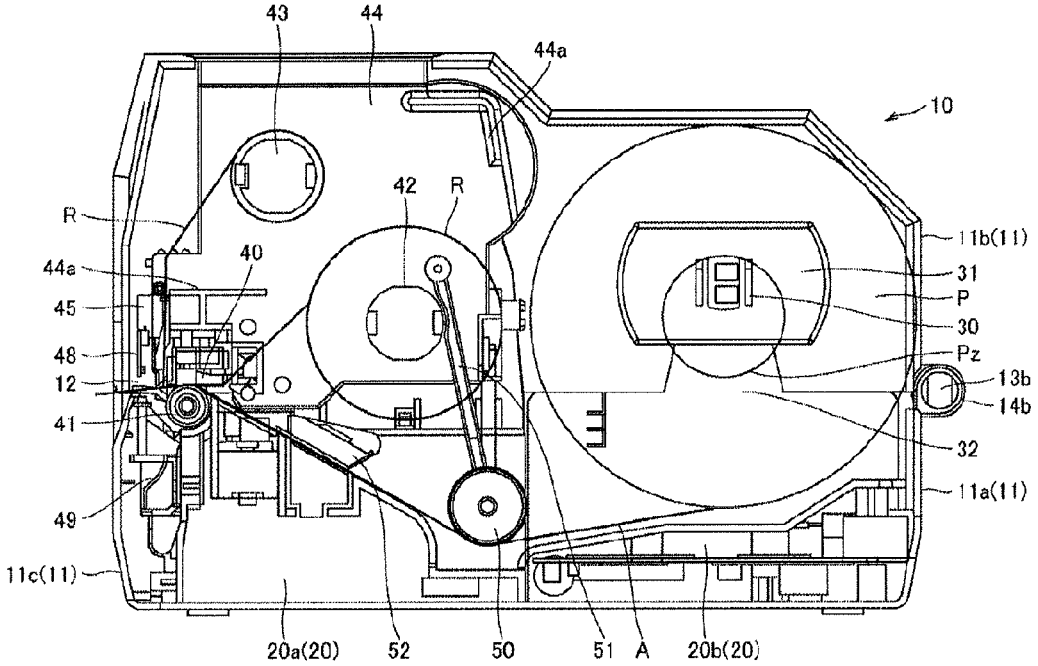
FIG. 4 is a conceptual diagram illustrating an internal structure of the printer of FIG. 1.

As illustrated in FIGS. 3 and 4, the printer 10 according to this embodiment extracts, in a sheet shape, a roll-like continuous paper sheet P having a plurality of labels temporarily attached with a predetermined interval along a longitudinal direction of a long liner having a surface applied with a releasing agent, and print predetermined information on the labels. The printer 10 has a main body 20 defining a conveying passage A of the continuous paper sheet P.

It is noted that the print medium printed by the printer 10 is not limited to the continuous paper sheet P. Instead, various other print media may also be employed, such as a tag continuous paper sheet having successive tags (labels of shipping tags or price tags) or individual label or tag pieces obtained by segmenting the label continuous paper sheet or the tag continuous paper sheet.

Figure 5:
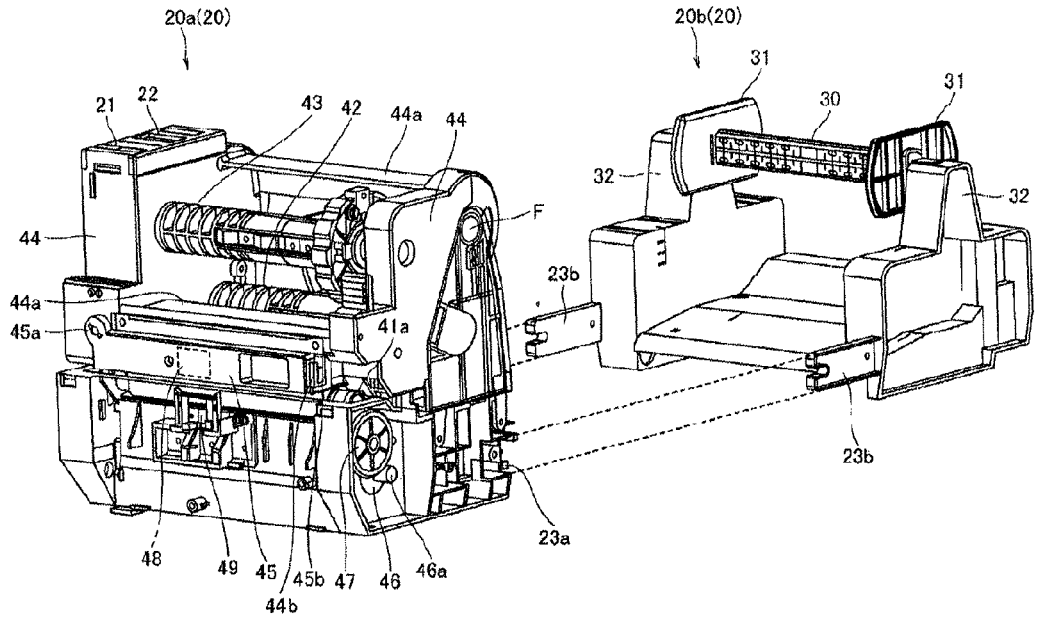
FIG. 5 is an exploded perspective view illustrating a main body of the printer of FIG. 1.
Figure 6:
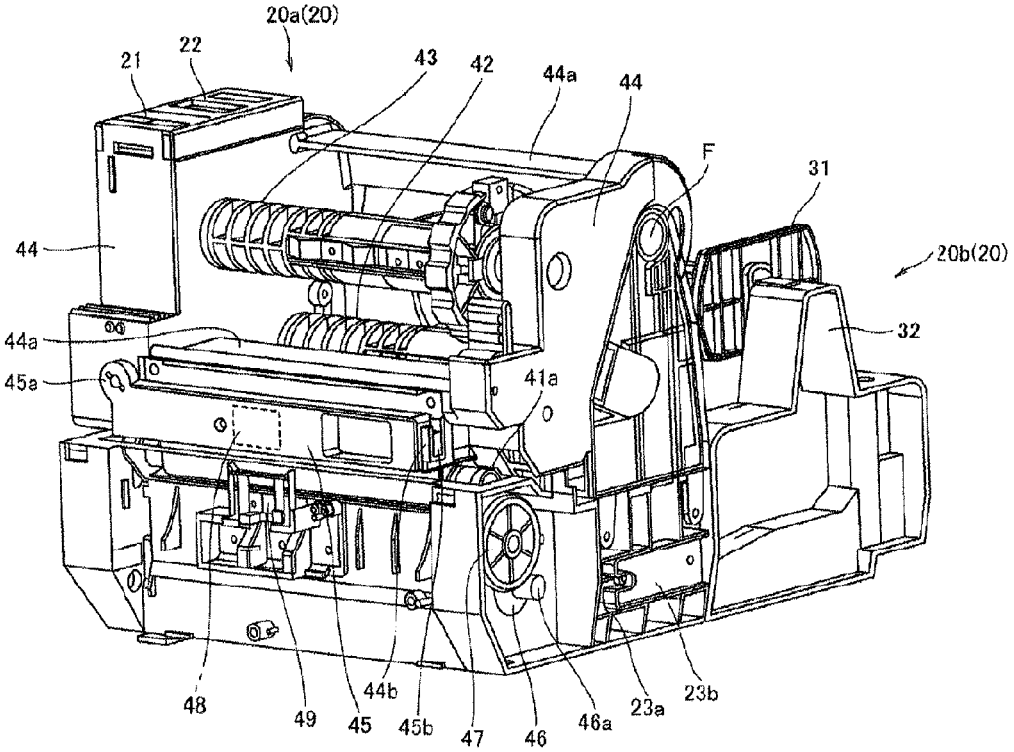
FIG. 6 is a perspective view illustrating the main body of the printer of FIG. 1.

As illustrated in FIGS. 4 and 5, the main body 20 has a print unit 20*a* that performs printing on the continuous paper sheet P and a feeding unit 20*b* that feeds the continuous paper sheet P to the print unit 20*a*. In addition, as connective concave portions 23*a* formed in both ends of the width direction of the print unit 20*a* are fitted to connective convex portions 23*b* formed in both ends of the width direction of the feeding unit 20*b* to match the connective concave portions 23*a*, the print unit 20*a* and the feeding unit 20*b* are integrally connected to each other as illustrated in FIG. 6.

In FIGS. 4 and 5, the feeding unit 20*b* has a core guide 30 that penetrates through a core PZ of the continuous paper sheet P wound around in a roll shape and rotatably supports the continuous paper sheet P, a pair of roll width regulating guides 31 slidably installed across the core guide 30 to regulate both side surfaces of the continuous paper sheet P supported by the core guide 30, and a core guide support portion 32 that supports both ends of the core guide 30.

The print unit 20*a* is provided with a thermal head 40 (print head) having a heating element and a platen roller 41 rotatably provided to face the thermal head 40. The thermal head 40 and the platen roller 41 constitute a print unit.

In addition, the print unit 20*a* is provided with a ribbon feeding shaft 42 that rotatably supports the ink ribbon R (as an example of the long sheet material) impregnated with ink and wound around in a roll shape to feed the ink ribbon R to the thermal head 40, and a ribbon winding shaft 43 (as an example of the long sheet material holding device) that winds out the consumed ink ribbon R subjected to heat transfer of ink to the continuous paper sheet P through the thermal head 40. It is noted that the ink ribbon R extracted from the ribbon feeding shaft 42 defining a traveling path going by way of the thermal head 40 and is wound around the ribbon winding shaft 43.

The platen roller 41 is formed of a hard rubber member and has a platen gear 41*a* installed in one end. The platen gear 41*a* is coupled to a driving gear 46*a* installed in a rotation shaft of the driving motor 46 via a gear 47 so that the platen roller 41 is rotatably driven by the driving motor 46. In addition, the thermal head 40 is pressed toward the platen roller 41 by an elastic element (not shown) provided in the thermal head 40.

Therefore, as the platen roller 41 is rotated along with the thermal head 40 by nipping the continuous paper sheet P, the roll-like continuous paper sheet P supported by the core guide 30 is extracted and conveyed. As a result, the conveying passage A of the continuous paper sheet P is formed in the main body 20. In addition, predetermined information is printed by the thermal head 40 while the rear surface of the continuous paper sheet P is supported by the platen roller 41.

The roll-like continuous paper sheet P supported by the core guide 30 is extracted, and a damper roller 50 is arranged in the conveying passage A of the continuous paper sheet Pup to the thermal head 40. The damper roller 50 has an upper end rotatably supported by the lower end of the roller suspension rod 51 installed in the support frame 44 via a shaft portion 50*a*. As the damper roller 50 is rotated by pressing the continuous paper sheet P, the continuous paper sheet P is conveyed along the defined conveying passage A in a tensioned state without being loosened.

It is noted that, along the conveying passage A ranging from the damper roller 50 to the thermal head 40, a sensor for detecting existence of the continuous paper sheet P is embedded, and a width regulating guide 52 that regulates the width direction of the continuous paper sheet P in a proper position and guides the continuous paper sheet P to the thermal head 40 is further arranged.

The aforementioned support frame 44 is provided as a pair connected to each other with a connecting plate 44*a* arranged suitably. In addition, a pair of the support frames 44 support both ends of the thermal head 40, the platen roller 41, the ribbon feeding shaft 42, and the ribbon winding shaft 43, and the upper end of the roller suspension rod 51 opposite to the damper roller 50. It is noted that the input unit 21 and the display unit 22 described above are arranged on the upper surface of one of the support frames 44.

It is noted that the printer according to this embodiment is a heat transfer type printer using the thermal head 40 as a print head. However, a dot impact type printer may also be employed, in which fine tips corresponding to dots arranged lengthwise and breadthwise are tapped to the ink ribbon R.

In the vicinity of the downstream side of the thermal head 40 in the (print unit 20*a* of the) main body 20, a sensor unit 45 having a sensor 48 for detecting the continuous paper sheet P placed in the corresponding position is installed to face the thermal head 40 and match the traveling path of the ink ribbon R. In addition, a sensor 49 is arranged in the opposite side of the sensor 48 with respect to the continuous paper sheet P.

Here, the sensor 49 is formed from a light-emitting element, and the sensor 48 provided in the sensor unit 45 is formed from a photodetector capable of receiving light irradiated from the sensor 49. Therefore, when the continuous paper sheet P is placed between the sensors 48 and 49, the light from the sensor 49 is blocked by the continuous paper sheet P, so that the sensor 48 does not receive the light, and it is detected that the continuous paper sheet P is positioned in the downstream side of the thermal head 40. Meanwhile, when the continuous paper sheet P is not placed between the sensors 48 and 49, the light from the sensor 49 is received by the sensor 48, so that it is detected that there is no continuous paper sheet P in the downstream side of the thermal head 40.

Figure 7:
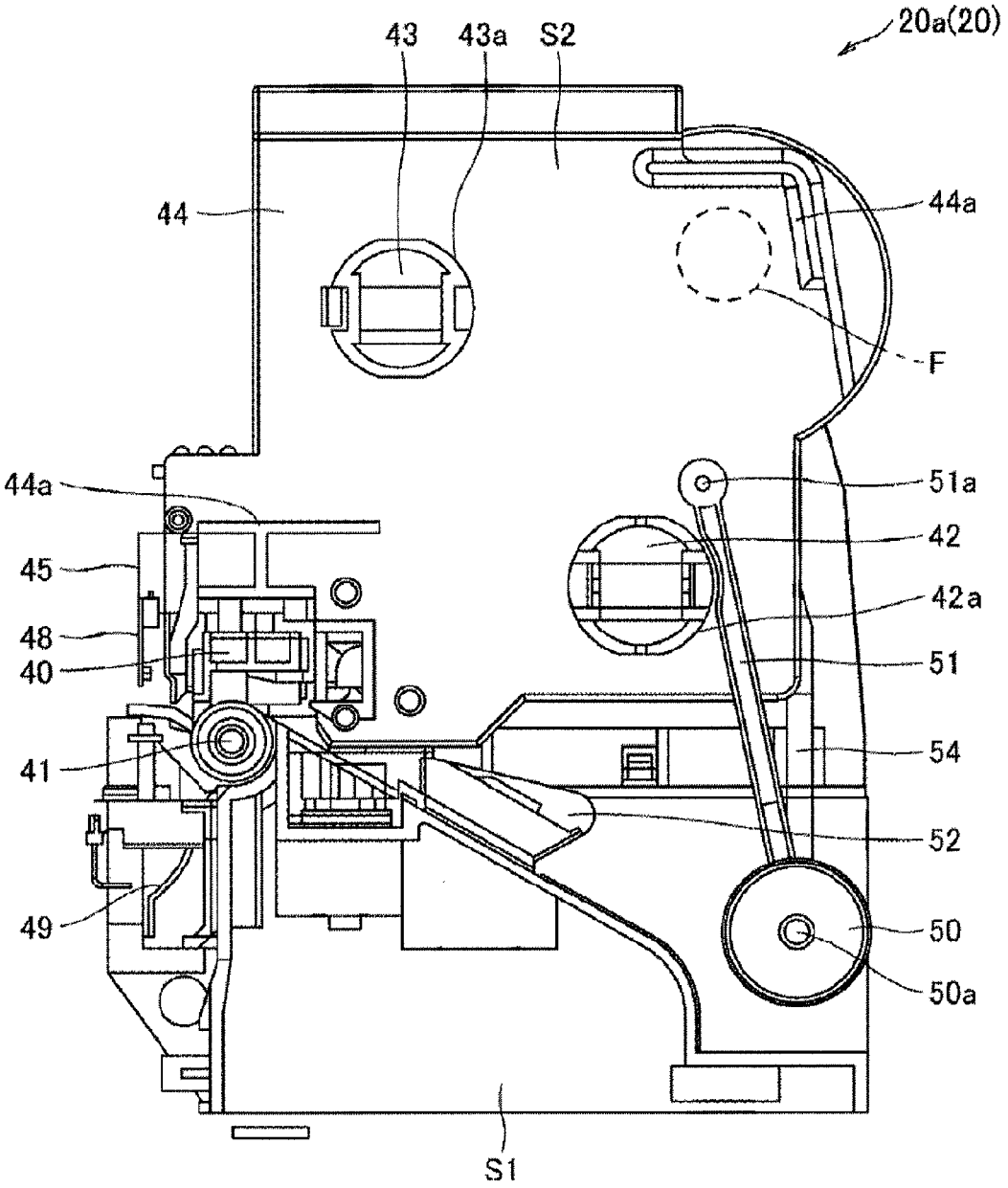
FIG. 7 is a side view illustrating a print unit of the main body of the printer of FIG. 1.
Figure 8:
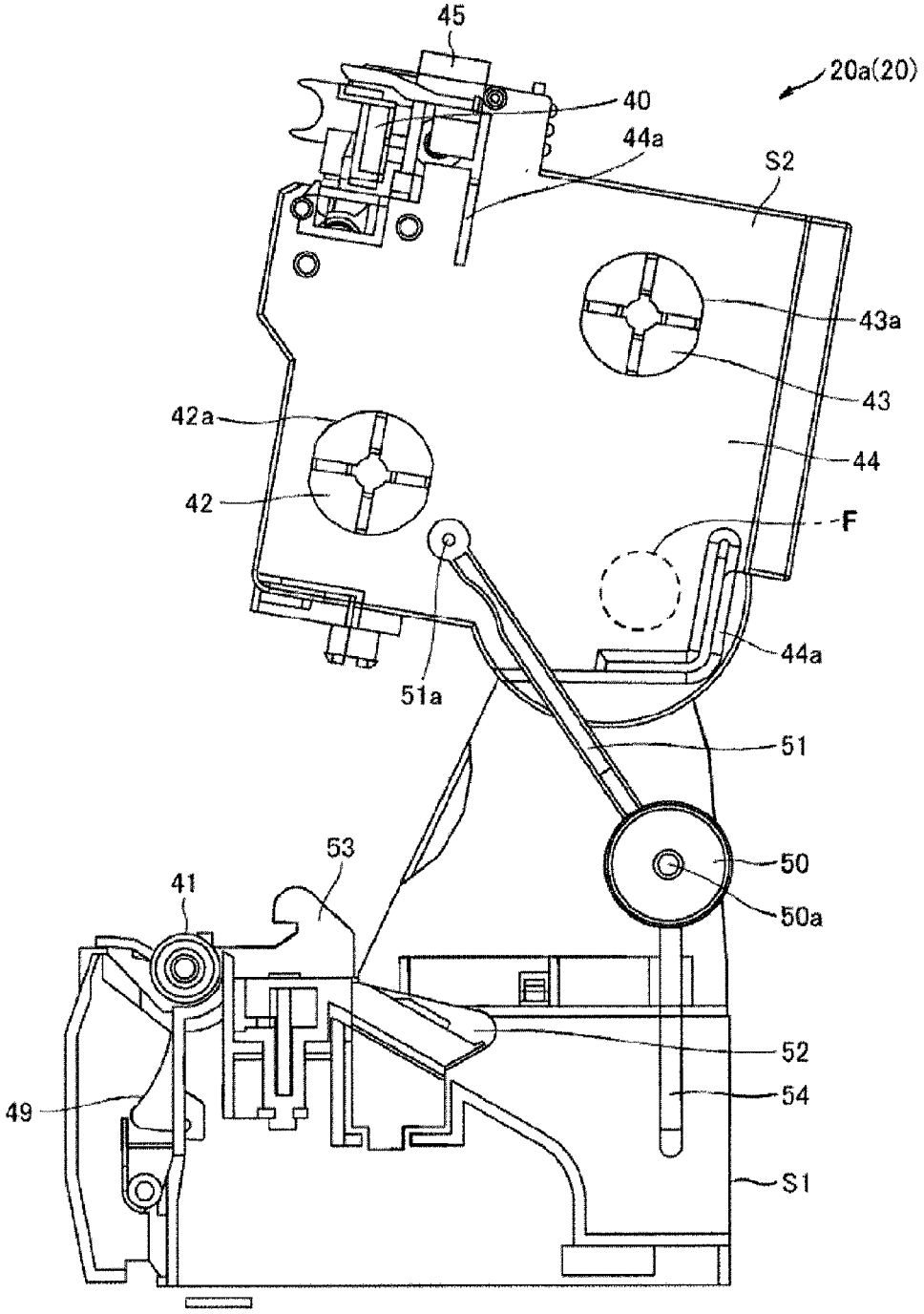
FIG. 8 is a side view illustrating an open state of the print unit of FIG. 7.

As illustrated in FIG. 7, the print unit 20*a* of the main body 20 includes a lower print unit S1 (lower main body) having the platen roller 41, and an upper print unit S2 (upper main body) having the thermal head 40 or the support frame 44. In addition, as illustrated in FIG. 8, the upper print unit S2 is installed in the lower print unit S1 by using the pivot point F and is pivoted with respect to the pivot point F so as to be opened from or closed to the lower print unit S1.

The lower print unit S1 is provided with a locking claw 53, and the upper print unit S2 is provided with a locking pin (not shown) engaged with the locking claw 53 when the print unit 20*a* is closed. In addition, when the locking pin is engaged with the locking claw 53, the upper print unit S2 is locked to the lower print unit S1 in a closed position, so that opening is prohibited. It is noted that, in order to open the upper print unit S2, the engagement between the locking pin and the locking claw 53 may be released by handling a release lever (not shown) and pivoting the upper print unit S2 upward with respect to the pivot point F.

The lower print unit S1 has the sensor 49 or the width regulating guide 52 in addition to the platen roller 41. Furthermore, the lower print unit S1 has a long hole 54 extending in a vertical direction. The shaft portion 50*a* of the damper roller 50 is inserted into the long hole 54, so that the damper roller 50 can move vertically. It is noted that the damper roller 50 is rotatably supported by the lower end of the roller suspension rod 51 via the shaft portion 50*a* as described above.

Meanwhile, the upper print unit S2 has the ribbon feeding shaft 42, the ribbon winding shaft 43, and the sensor unit 45 having the sensor 48 in addition to the thermal head 40 and the support frame 44. In addition, the upper print unit S2 is provided with the roller support portion 51*a* that pivotably supports the upper end of the roller suspension rod 51.

It is noted that the support frame 44 is provided with shaft support portions 42*a* and 43*a* that detachably support the ribbon feeding shaft 42 and the ribbon winding shaft 43, respectively. In addition, the shaft support portion 43*a* corresponding to the ribbon winding shaft 43 is provided to be rotatable by virtue of a driving force from the motor 46 by interposing a plurality of gear trains and a transmission gear (not shown) provided in the end of the side distant from platen gear 41*a*.

As illustrated in FIG. 7, when the upper print unit S2 is closed, the damper roller 50 supported by the roller suspension rod 51 is placed under the long hole 54. In comparison, as illustrated in FIG. 8, when the upper print unit S2 is opened, the roller suspension rod 51 is pulled to the roller support portion 51*a* elevated as the upper print unit S2 is pivoted. In addition, the damper roller 50 supported by the roller suspension rod 51 moves to the upside of the long hole 54.

Therefore, when the continuous paper sheet P is set on the printer 10, the upper print unit S2 is set to the open position by opening the upper casing 11*b*, so that the damper roller 50 moves to the upside of the long hole 54. As a result, it is possible to easily cause the continuous paper sheet P to pass through a nipping portion between the thermal head 40 and the platen roller 41.

The sensor unit 45 having the sensor 48 for detecting the continuous paper sheet P in the vicinity of the downstream side of the thermal head 40 is provided pivotably upward with respect to the point 45*a* provided in one end (FIGS. 5 and 6) of the width direction of the thermal head 40.

As illustrated in FIGS. 3 to 7, in the first position where the sensor unit 45 faces the thermal head 40 so that the sensor 48 can detect the continuous paper sheet P, a holding protrusion 45*b* protruding to the opposite side of the point 45*a* of the sensor unit 45 is held by a holding portion 44*b* provided in the support frame 44 (refer to FIGS. 5 and 6).

As the sensor unit 45 is pivoted upward with respect to the point 45*a* from the first position, the sensor unit 45 moves to the second position farther than the first position from the thermal head 40. In this second position, a wide space is formed in front of the thermal head 40 since the sensor unit 45 does not exist. For this reason, if the ink ribbon R is mounted by setting the sensor unit 45 in the second position as described below, it is possible to cause the ink ribbon R to pass through a gap between the thermal head 40 and the sensor 48.

Meanwhile, the ink ribbon R is replaced through the following sequence.

First, the ribbon winding shaft 43 is uninstalled from the shaft support portion 43*a* of the support frame 44, and the consumed ink ribbon R wound around the ribbon winding shaft 43 is removed. Then, the ribbon winding shaft 43 is installed to the shaft support portion 43*a* of the support frame 44 again.

Subsequently, the upper print unit S2 is switched from the close position (FIG. 7) to the open position (FIG. 8), and the ribbon feeding shaft 42 is uninstalled from the shaft support portion 42*a* of the support frame 4. Then, a new ink ribbon R is set in the ribbon feeding shaft 42.

Subsequently, the sensor unit 45 is pivoted from the first position to the second position, so that the sensor unit 45 does not exist in front of the thermal head 40. In this state, a tip of the new ink ribbon R is extracted from the ribbon feeding shaft 42, is guided to the ribbon winding shaft 43 by way of the thermal head 40, and is fixed to the ribbon winding shaft 43. After the fixing, the ink ribbon R is tightened by rotating the ribbon feeding shaft 42 or the ribbon winding shaft 43.

After the ink ribbon R is installed in this manner, the sensor unit 45 is returned from the second position to the first position through pivoting (so that the ink ribbon R is interposed between the sensor unit 45 and the thermal head 40), and the upper print unit S2 is returned from the open position (FIG. 8) to the close position (FIG. 7). As a result, replacement of the ink ribbon R is completed.

When the sensor unit 45 is placed in the first position, a gap is formed between the sensor unit 45 and the thermal head 40. This gap defines a part of the traveling path of the ink ribbon R extending from the ribbon feeding shaft 42 to the ribbon winding shaft 43.

Figure 9:
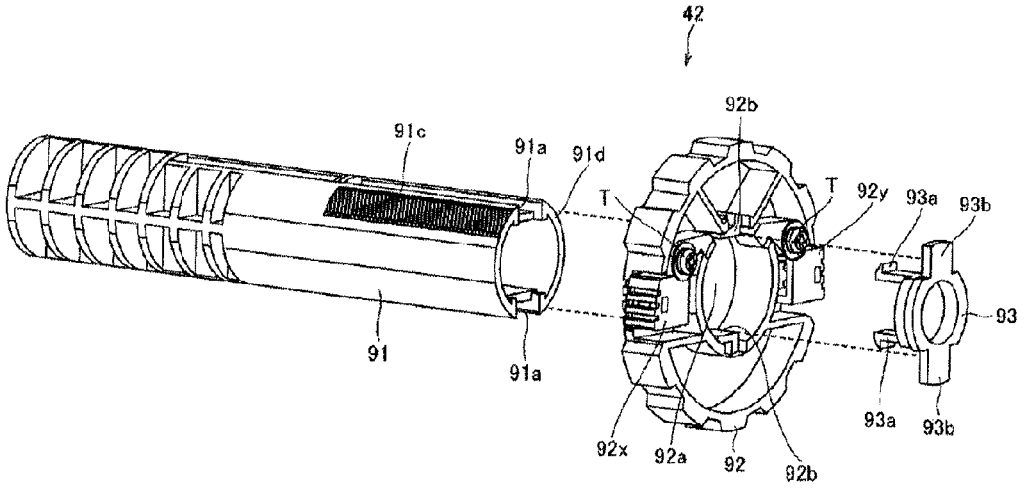
FIG. 9 is an exploded perspective view illustrating a ribbon feeding shaft installed in the printer of FIG. 1.
Figure 10:
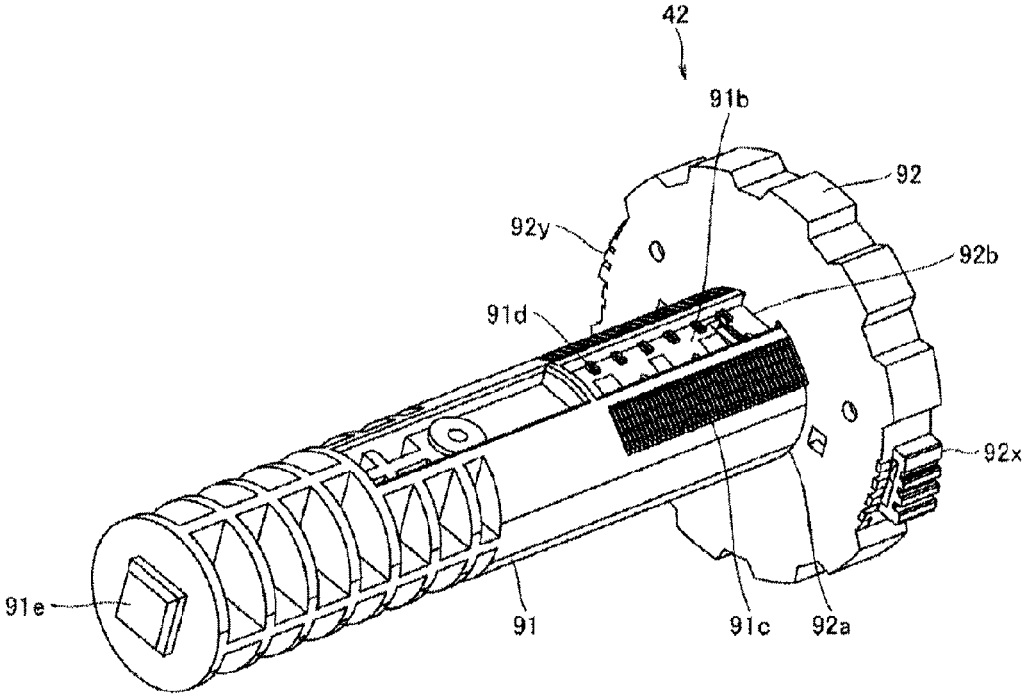
FIG. 10 is a perspective view illustrating the ribbon feeding shaft installed in the printer of FIG. 1 as seen from an angle different from that of FIG. 9.

Here, as illustrated in FIGS. 9 and 10, the ribbon feeding shaft 42 is provided with a holding shaft 91 that windingly holds the ink ribbon R as a long sheet material in a roll-like manner and an annular regulating member 92 having a through-hole 92*a* where the holding shaft 91 is inserted thereinto and move along its axial direction in order to regulate a position of the ink ribbon R wound around the holding shaft 91.

Long grooves 91*a* extending from the end in the axial direction are formed in two portions of the holding shaft 91 radially opposite to each other in the side into which the regulating member 92 is inserted. Meanwhile, a protrusion 92*b* is formed in the through-hole 92*a* of the regulating member 92 to match the long groove 91*a* of the holding shaft 91. Therefore, the regulating member 92 is movable along the axial direction of the holding shaft 91 while the protrusion 92*b* is inserted into the long groove 91*a*. As a result, the regulating member 92 is not rotatable against the holding shaft 91.

It is noted that a scale 91*b* indicating a fixing position of the regulating member 92 with respect to the holding shaft 91 corresponding to the width of the ink ribbon R wound around the holding shaft 91 is formed inside the opposite long groove 91*a* of the holding shaft 91. As the scale 91*b*, for example, numerical figures such as "60," "70," or "80"

are engraved to match the width of the ink ribbon R. Therefore, for example, when an ink ribbon R having a width of 60 mm is installed in the ribbon feeding shaft 42, it is possible to easily regulate the ink ribbon R in a proper position of the holding shaft 91 (for example, a center of the holding shaft 91) by adjusting the regulating member 92 to a position of "60" out of the scale 91*b* of the holding shaft 91.

A pair of first locking groove trains 91*c* and 91*d* are formed in the holding shaft 91 in parallel with each other along the axial direction of the holding shaft 91 in both sides of the long groove 91*a* having scale 91*b*.

It is noted that, herein, a phrase "arranged or provided in parallel" is not limited to a state that a pair of first locking groove trains 91*c* is provided side by side longitudinally as illustrated in FIGS. 9 and 10. That is, for example, a pair of first locking groove trains 91*c* may be provided oppositely in a radial direction of the holding shaft 91 regardless of an interval between a pair of first locking groove trains 91*c*.

The first locking groove trains 91*c* and 91*d* are sets of plural successive grooves 61*c* and 61*d* extending across the axial direction of the holding shaft 91.

Figure 11:
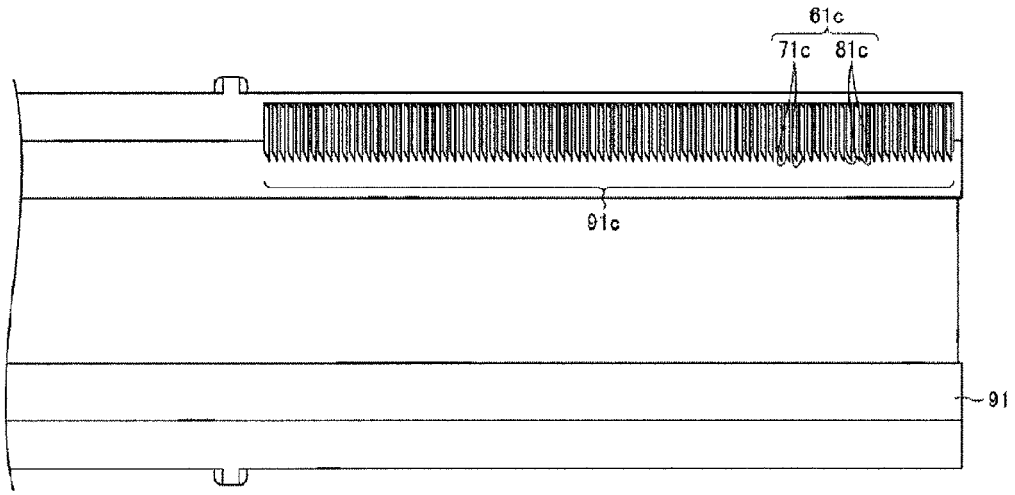
FIG. 11 is a side view illustrating main components of the holding shaft of the ribbon feeding shaft installed in the printer of FIG. 1.
Figure 12:
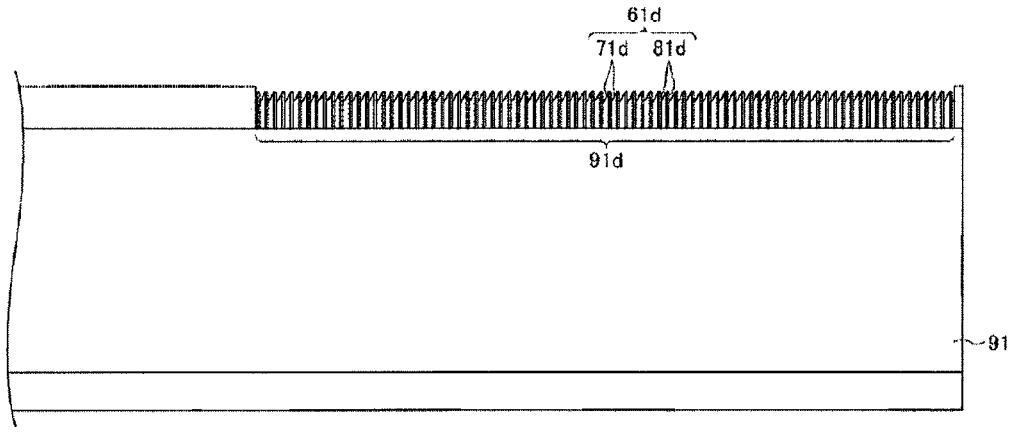
FIG. 12 is a side view illustrating main components of the holding shaft of the ribbon feeding shaft installed in the printer of FIG. 1 as seen from the opposite side to that of FIG. 11.

As illustrated in FIGS. 11 and 12, the grooves 61*c* and 61*d* have slope surfaces 71*c* and 71*d*, respectively, sloped along the axial direction of the holding shaft 91 and oppositely to each other, and perpendicular surfaces 81*c* and 81*d* perpendicular to the axial direction of the holding shaft 91.

Meanwhile, the aforementioned regulating member 92 are provided with a pair of locking members 92*x* and 92*y* corresponding to the pair of first locking groove trains 91*c* and 91*d*, respectively, in order to fix the regulating member 92 to the holding shaft 91.

A pair of locking members 92*x* and 92*y* are provided with second locking groove trains 92*c* and 92*d*, respectively, having a series of grooves 62*c* and 62*d*, respectively, having surfaces to match the slope surfaces 71*c* and 71*d*, respectively, and the perpendicular surfaces 81*c* and 81*d*, respectively, of the grooves 61*c* and 61*d*, respectively, of the first locking groove trains 91*c* and 91*d*, respectively (that is, having the surfaces 72*c* and 82*c* corresponding to the slope surface 71*c* and perpendicular surface 81*c*, respectively, of the groove 61*c*, and the surfaces 72*d* and 82*d* corresponding to the slope surface 71*d* and the perpendicular surface 81*d*, respectively, of the groove 61*d*) (refer to FIG. 13).

As the second locking groove trains 92*c* and 92*d* are engaged with the first locking groove trains 91*c* and 91*d*, the regulating member 92 is fixed to the holding shaft 91.

Figure 14:
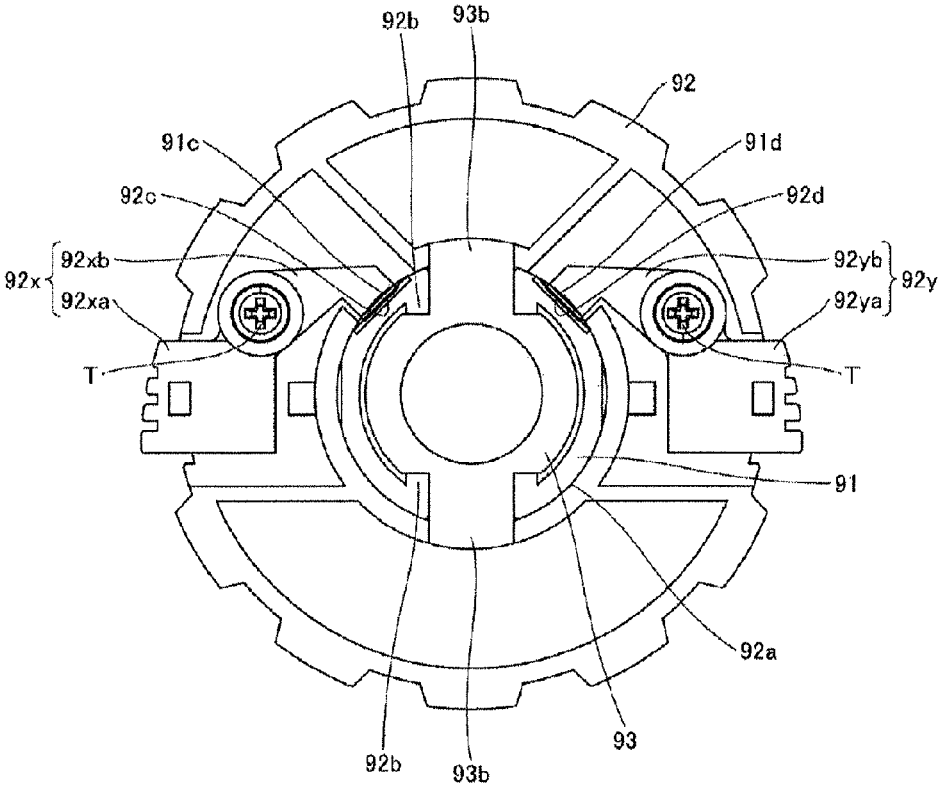
FIG. 14 is a diagram illustrating the ribbon feeding shaft installed in the printer of FIG. 1 to see the regulating member in the front view.

Here, as illustrated in FIG. 14, a pair of locking members 92*x* and 92*y* have control knobs 92*xa* and 92*ya*, respectively, protruding outward from the outer diameter of the regulating member 92 to allow manipulation of an operator, and groove train portions 92*xb* and 92*yb*, respectively, formed in the side opposite to the control knobs 92*xa* and 92*ya*, respectively, with respect to a swing point T and provided with the second locking groove trains 92*c* and 92*d*, respectively. In addition, the locking members 92*x* and 92*y* are displaced by swinging between an engagement position where the second locking groove trains 92*c* and 92*d* are engaged with the first locking groove trains 91*c* and 91*d*, respectively, of the holding shaft 91 and a disengagement position where the second locking groove trains 92*c* and 92*d* are disengaged from the first locking groove trains 91*c* and 91*d*, respectively.

In addition, the regulating member 92 is provided with a biasing member (not shown) such as a torsion spring or a plate spring in order to bias the locking members 92*x* and 92*y* toward the engagement position.

As an operator manipulates the control knobs 92*xa* and 92*ya* of a pair of locking members 92*x* and 92*y* against the biasing force of the biasing member, the locking members 92*x* and 92*y* are displaced from the engagement position to the disengagement position, so that the regulating member 92 can move along the axial direction of the holding shaft 91.

In this case, the control knobs 92*xa* and 92*ya* of a pair of locking members 92*x* and 92*y* move to make an arc with respect to the swing point T. Therefore, an operator can displace the locking members 92*x* and 92*y* from the engagement position to the disengagement position with easy manipulation by pressing the control knobs 92*xa* and 92*ya* slanted along the aforementioned arc shape instead of pressing toward the center of the regulating member 92.

Therefore, it is possible to easily perform, with one hand, a work for uninstalling the regulating member 92 from the holding shaft 91 or a work for changing a position of the regulating member 92 inserted into the holding shaft 91.

It is noted that the structures of the locking members 92*x* and 92*y* are not limited to a swingable structure as described in this embodiment. Instead, various structures may be employed as long as the locking members 92*x* and 92*y* can be displaced between an engagement position where the second locking groove trains 92*c* and 92*d* are engaged with the first locking groove trains 91*c* and 91*d* and a disengagement position where the second locking groove trains 92*c* and 92*d* are disengaged from the first locking groove trains 91*c* and 91*d*.

As illustrated in FIG. 9, a stopper 93 is inserted into one end of the holding shaft 91 in order to prevent removal of the regulating member 92 from the holding shaft 91.

That is, the stopper 93 is provided with a pair of locking portions 93*a* extending in the axial direction of the holding shaft 91 and a pair of stopper pieces 93*b* protruding in a radial direction. In addition, as the stopper 93 is inserted into the holding shaft 91 while the regulating member 92 is installed in the holding shaft 91, the locking portion 93*a* is engaged with a concave portion (not shown) formed in an inner wall of the holding shaft 91, and the stopper 93 is fixed to the holding shaft, so that the stopper piece 93*b* interferes with the regulating member 92 so as to prevent removal of the regulating member 92 from the holding shaft 91.

It is noted that the stopper 93 may not be necessarily provided because it aims to prevent the regulating member 92 from being removed from the holding shaft 91 unintentionally.

On the end surface of the holding shaft 91 opposite to the side where the stopper 93 is inserted, a convex portion 91*e* is for need to provide a joint for transmitting a driving force from the motor 46. It is noted that, as described above, the driving force from the motor 46 is transmitted to the ribbon winding shaft 43, but is not transmitted to the ribbon feeding shaft 42. Therefore, the convex portion 91*e* of the ribbon feeding shaft 42 does not substantially serve as a joint, unlike the convex portion 91*e* of the ribbon winding shaft 43.

Figure 15:
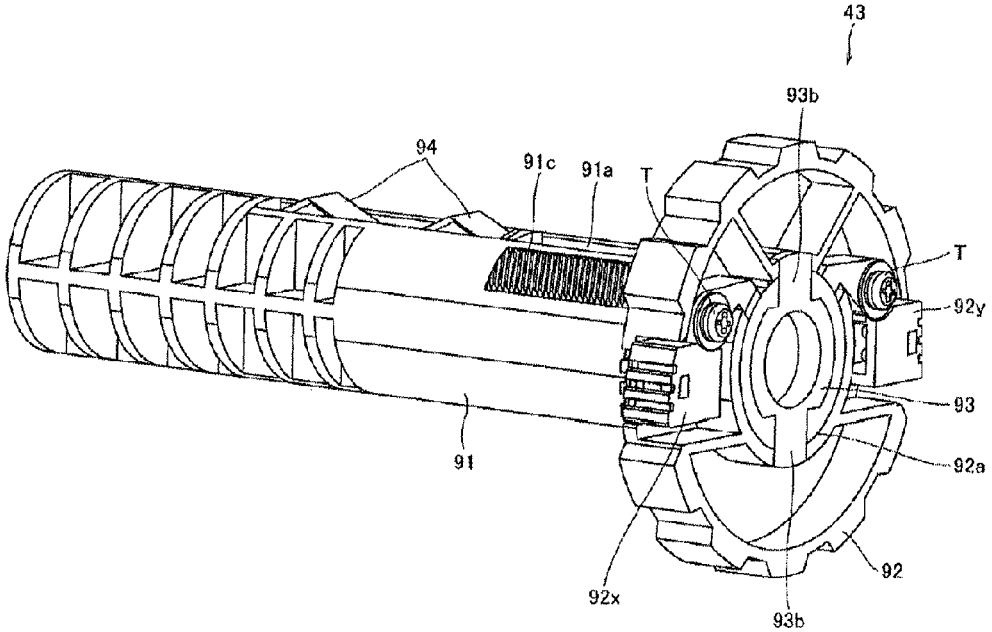
FIG. 15 is a perspective view illustrating the ribbon winding shaft installed in the printer of FIG. 1.

While the structure of the ribbon feeding shaft 42 has been described hereinbefore, the ribbon winding shaft 43 has a similar structure as illustrated in FIG. 15.

It is noted that the holding shaft 91 of the ribbon winding shaft 43 is provided with a catch 94 such as a plate spring in order to prevent a pipe-like member (not shown) for fixing a tip of the ink ribbon R to be wound from being drifted when it is inserted as illustrated in FIG. 15. Similarly, the holding shaft 91 of the ribbon feeding shaft 42 is provided with a catch 94 such as a plate spring in order to prevent a pipe-like member (not shown) wound with the ink ribbon R from being drifted when it is inserted. Note that the catch of the ribbon feeding shaft 42 is not illustrated for simplicity purposes.

In the ribbon feeding shaft 42 having the aforementioned structure, both of the plurality of grooves 61*c* and 61*d* of the first locking groove trains 91*c* and 91*d* of the holding shaft 91 and the plurality of grooves 62*c* and 62*d* of the second locking groove trains 92*c* and 92*d* formed in the locking members 92*x* and 92*y* of the regulating member 92 and engaged with the first locking groove trains 91*c* and 91*d* are formed successively in series. Therefore, it is possible to accurately adjust a position of the regulating member 92 inserted into the holding shaft 91.

The series of grooves 61*c* and 61*d* of the pair of first locking groove trains 91*c* and 91*d* of the holding shaft 91 are provided in parallel along the axial direction of the holding shaft 91 and extend across the axial direction of the holding shaft 91. The series of grooves 61*c* and 61*d* have the slope surfaces 71*c* and 71*d* sloped along the axial direction of the holding shaft 91 and oppositely to each other and the perpendicular surfaces 81*c* and 81*d* perpendicular to the axial direction of the holding shaft 91.

Meanwhile, the series of grooves 62*c* and 62*d* of the second locking groove trains 92*c* and 92*d* of the pair of locking members 92*x* and 92*y* engaged with the pair of first locking groove trains 91*c* and 91*d* to fix the regulating member 92 to the holding shaft 91 have surfaces to match each of the slope surfaces 71*c* and 71*d* and each of the perpendicular surfaces 81*c* and 81*d* of the grooves 61*c* and 61*d* of the first locking groove trains 91*c* and 91*d*, i.e., the surfaces 72*c* and 82*c* corresponding to the slope surface 71*c* and the perpendicular surface 81*c*, respectively, of the groove 61*c* and the surfaces 72*d* and 82*d* corresponding to the slope surface 71*d* and the perpendicular surface 81*d*, respectively, of the groove 61*d*.

Figure 13A:
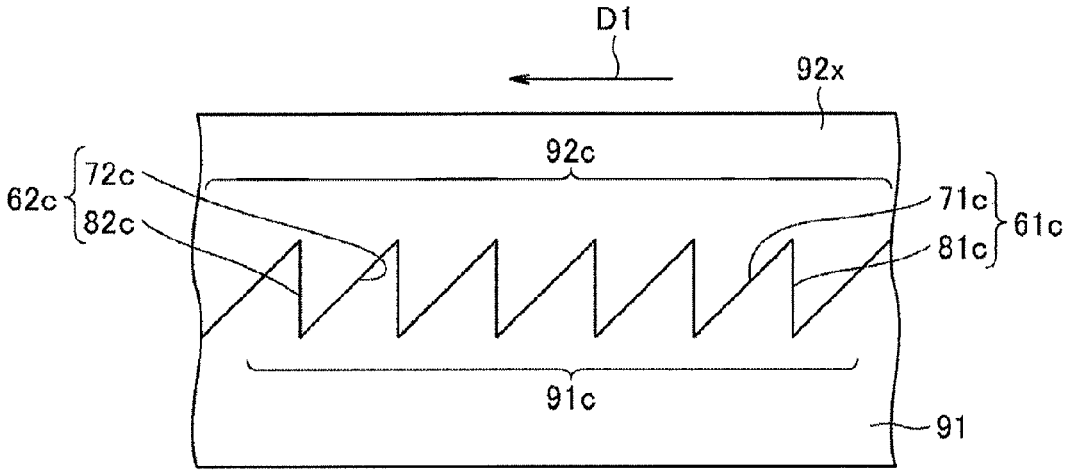
FIG. 13A is an explanatory diagram illustrating a state that one of the first locking groove trains formed in the holding shaft of the ribbon feeding shaft installed in the printer of FIG. 1 is engaged with the second locking groove train formed in one of the locking members provided in the regulating member.

Therefore, when the regulating member 92 is inserted into the holding shaft 91, and the first locking groove trains 91*c* and 91*d* of the holding shaft 91 are engaged with the second locking groove trains 92*c* and 92*d*, respectively, of the locking members 92*x* and 92*y* of the regulating member 92, the first locking groove train 91*c* of the holding shaft 91 is engaged with the second locking groove train 92*c* of the locking member 92*x* provided in the regulating member 92 as illustrated in FIG. 13A. As a result, as the regulating member 92 tries to move toward the arrow direction D1 (that is, move along the longitudinal direction (axial direction) of the holding shaft 91 from one end side of the holding shaft 91 provided with the stopper 93 toward the other end side provided with the convex portion 91*e*), the surface 82*c* of the second locking groove train 92*c* abuts on the perpendicular surface 81*c* of the first locking groove train 91*c* perpendicular to the axial direction of the holding shaft 91, so that a slide of the regulating member 92 with respect to the holding shaft 91 is prevented.

Figure 13B:
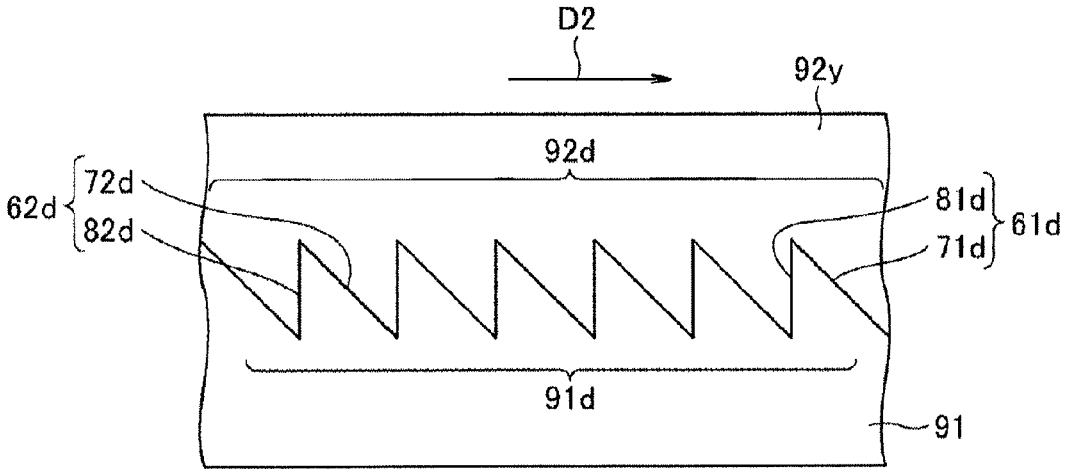
FIG. 13B is an explanatory diagram illustrating a state that the other one of the first locking groove trains formed in the holding shaft of the ribbon feeding shaft installed in the printer of FIG. 1 is engaged with the second locking groove train formed in the other locking member provided in the regulating member.

In addition, the first locking groove train 91*d* of the holding shaft 91 is engaged with the second locking groove train 92*d* of the locking member 92*y* of the regulating member 92 as illustrated in FIG. 13B. As a result, as the regulating member 92 tries to move in the arrow direction D2 opposite to the arrow direction D1 (FIG. 13A) (that is, move along the longitudinal direction (axial direction) of the holding shaft 91 from the other end side of the holding shaft 91 provided with the convex portion 91*e* toward the one end side provided with the stopper 93), the surface 82*d* of the second locking groove train 92*d* abuts on the perpendicular surface 81*d* of the first locking groove train 91*d* perpendicular to the axial direction of the holding shaft 91, so that a slide of the regulating member 92 with respect to the holding shaft 91 is prevented.

Therefore, by virtue of engagement between the first locking groove trains 91*c* and 91*d* of the holding shaft 91 and the second locking groove trains 92*c* and 92*d* of the locking members 92*x* and 92*y* of the regulating member 92, a locking strength between the regulating member 92 and the holding shaft 91 is improved. As a result, even when a strong force is applied to the regulating member 92, a positional deviation of the regulating member 92 is not easily generated in both directions from the one end side to the other end side or from the other end side to the one end side of the holding shaft 91.

While the embodiments of the invention embodied by the inventors have been described hereinbefore specifically, it should be appreciated that the embodiments disclosed herein are just for illustrative purposes and are not intended to limit the scope of the invention. Naturally, the technical scope of this invention should not be interpreted in a restrictive sense based on the description of the embodiment. Instead, the broadest interpretation should be made based on the appended claims. Therefore, the scope of the invention should be construed by the appended claims and their equivalents, and various other changes or modifications may be possible without departing from the spirit and scope of the invention.

For example, although the embodiment has been described hereinbefore for a case where the long sheet material holding device according to this invention is applied to the ribbon feeding shaft 42 or the ribbon winding shaft 43 of the printer 10, the long sheet material holding device according to the this invention may also be employed in various devices for holding various long sheet materials in a roll shape without limiting to such a ribbon feeding shaft 42 or ribbon winding shaft 43.

As described above, this invention is applied to a stand-alone type printer not connected to a personal computer (PC) but provided with the input unit. However, this invention may also be applied to an online type printer connected to a PC whereby necessary input manipulations are performed.

REFERENCE SIGNS AND NUMERALS

10 printer
11 housing
11*a* lower casing
11*b* upper casing
11*c* front cover
12 discharge port
13*a*, 13*b*, 14*a*, 14*b* hinge portion
15 long hole
16 protrusion
17 pin hole
18 window hole
20 main body
20*a* print unit
20*b* feeding unit
21 input unit
22 display unit
23*a* connective concave portion
23*b* connective convex portion
30 core guide
31 roll width regulating guide
32 core guide support portion
40 thermal head
41 platen roller

41*a* platen gear
42 ribbon feeding shaft
42*a* shaft support portion
43 ribbon winding shaft
43*a* shaft support portion
44 support frame
44*a* connecting plate
44*b* holding portion
45 sensor unit
45*a* point
45*b* holding protrusion
46 driving motor
46*a* driving gear
47 gear
48, 49 sensor
50 damper roller
50*a* shaft portion
51 roller suspension rod
51*a* roller support portion
52 width regulating guide
53 locking claw
54 long hole
61*c*, 61*d* groove
62*c*, 62*d* groove
71*c*, 71*d* slope surface
72*c*, 72*d* surface
81*c*, 81*d* perpendicular surface
82*c*, 82*d* surface
91 holding shaft
91*a* long groove
91*b* scale
91*c*, 91*d* first locking groove train
91*e* convex portion
92 regulating member
92*a* through-hole
92*b* protrusion
92*c*, 92*d* second locking groove train
92*x*, 92*y* locking member
92*xa*, 92*ya* control knob
92*xb*, 92*yb* groove train portion
93 stopper
93*a* locking portion
93*b* stopper piece
94 catch
A conveying passage
F pivot point
P continuous paper sheet
Pz core
R ink ribbon
S1 lower print unit
S2 upper print unit
T swing point

The invention claimed is:

1. A long sheet material holding device comprising:

a holding shaft configured to hold a long sheet material in a roll shape;

a pair of first locking groove trains arranged in parallel with each other along the axial direction of the holding shaft, the pair of first locking groove trains having a series of grooves respectively, each of the series of grooves being provided with slope surfaces sloped along the axial direction of the holding shaft and perpendicular surfaces perpendicular to the axial direction of the holding shaft, the slope surfaces and the perpendicular surfaces, in each of the series of grooves, being positioned opposite to each other relative to the grooves formed therebetween with respect to the axial direction of the holding shaft from a first end to a second end;

a regulating member provided to be movable along the axial direction of the holding shaft, the regulating member being configured to regulate a position of the long sheet material held by the holding shaft; and a pair of locking members provided in the regulating member to match the pair of first locking groove trains, each of the locking members having a second locking groove train, the second locking groove train having a series of grooves, the series of grooves having surfaces to match the slope surfaces and the perpendicular surfaces of the grooves of the first locking groove train, the second locking groove trains being engaged with the first locking groove trains to fix the regulating member to the holding shaft.

2. The long sheet material holding device according to claim 1, wherein each of the pair of the locking members includes a control knob manipulated by an operator and a groove train portion positioned oppositely to the control knob with respect to a swing point, the groove train portion being provided with the second locking groove train, the locking members being swingable between an engagement position where the second locking groove trains are engaged with the first locking groove trains and a disengagement position where the second locking groove trains are disengaged from the first locking groove trains, the long sheet material holding device further includes a biasing member configured to bias the locking member toward the engagement position, and the locking member is displaced from the engagement position to the disengagement position when the control knobs of the pair of locking members are manipulated against a biasing force of the biasing member.

3. The long sheet material holding device according to claim 1, wherein the holding shaft is provided with a scale, the scale indicating a fixation position of the regulating member corresponding to a width of the long sheet material with respect to the holding shaft.

4. The long sheet material holding device according claim 1, further comprising a stopper provided at one end of the holding shaft, the stopper being configured to prevent the regulating member from being removed from the holding shaft.

5. A printer comprising:

a print head configured to print predetermined information on a print medium by using an ink ribbon;

a platen roller provided to face the print head by interposing the print medium;

a ribbon feeding shaft configured to feed the ink ribbon to the print head; and a ribbon winding shaft configured to wind out the ink ribbon, wherein any one of the ribbon feeding shaft and the ribbon winding shaft is the long sheet material holding device according to claim 1.

6. The long sheet material holding device according to claim 1, further comprising a catch configured to prevent a pipe-like member from being drifted when it is inserted to the holding shaft, the pipe-like member being configured to fix a tip of the long sheet material.

7. The long sheet material holding device according to claim 1, wherein the regulating member is not rotatable against the holding shaft.

8. The long sheet material holding device according to claim 1, wherein the holding shaft has a joint being configured to transmit a driving force from a motor.

9. The printer according to claim 5, wherein the ribbon feeding shaft and the ribbon winding shaft are detachable.

* * * * *